US010483070B1

(12) United States Patent
Beckert

(10) Patent No.: US 10,483,070 B1
(45) Date of Patent: Nov. 19, 2019

(54) FUSES AND METHODS OF FORMING FUSES

(71) Applicant: Littelfuse, Inc., Chicago, IL (US)

(72) Inventor: James J. Beckert, Rolling Meadows, IL (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/264,280

(22) Filed: Jan. 31, 2019

(51) Int. Cl.

| | |
|---|---|
| ***H01H 69/02*** | (2006.01) |
| ***H01H 85/18*** | (2006.01) |
| ***H01H 85/00*** | (2006.01) |
| *H01H 85/12* | (2006.01) |
| *H01H 85/147* | (2006.01) |
| *H01H 85/143* | (2006.01) |

(52) U.S. Cl.
CPC ..... *H01H 85/18* (2013.01); *H01H 69/02* (2013.01); *H01H 85/0013* (2013.01); *H01H 85/12* (2013.01); *H01H 85/143* (2013.01); *H01H 85/147* (2013.01)

(58) Field of Classification Search
CPC ..... H01H 69/02; H01H 85/0013; H01H 85/0017; H01H 85/0452; H01H 85/06; H01H 85/08; H01H 85/12; H01H 85/143; H01H 85/147; H01H 85/1755; H01H 85/18
See application file for complete search history.

(56) References Cited

U.S. PATENT DOCUMENTS

| | | | | |
|---|---|---|---|---|
| 4,409,582 | A * | 10/1983 | Kimmel | H01H 69/02 29/623 |
| 5,101,187 | A * | 3/1992 | Yuza | H01H 85/0417 337/255 |
| 5,668,522 | A * | 9/1997 | Kondo | H01H 85/0417 337/160 |
| 5,802,703 | A * | 9/1998 | Totsuka | H01H 85/044 206/713 |
| 5,841,338 | A * | 11/1998 | Yasukuni | H01H 85/0411 337/293 |
| 2002/0064999 | A1* | 5/2002 | Kobayashi | H01H 85/0417 439/620.34 |
| 2003/0024105 | A1* | 2/2003 | Chiu | H01H 85/0411 29/623 |
| 2009/0108980 | A1* | 4/2009 | Whitney | H01H 37/761 337/161 |
| 2010/0033293 | A1* | 2/2010 | Cheng | H01H 85/32 337/241 |
| 2010/0164677 | A1* | 7/2010 | Yang | H01H 85/0411 337/159 |

(Continued)

*Primary Examiner* — Jacob R Crum

(57) ABSTRACT

A fuse may include a leadframe including a first terminal having a first end and a second end, and a second terminal having a first end and a second end. A bridge may connect the respective second ends of the terminals. The bridge may have one or more protrusions disposed between the terminals and may be extended from the bridge. A base may have first and second apertures, and the first and second terminals may be at least partially disposed into the respective first and second apertures. The base may further include one or more indentations such that respective ends of the one or more protrusions are received in each of the one or more indentations. A plurality of wires may be connected from the first terminal to the second terminal, and each of the protrusions therebetween.

19 Claims, 10 Drawing Sheets

(56) References Cited

U.S. PATENT DOCUMENTS

| | | | | |
|---|---|---|---|---|
| 2015/0340189 | A1* | 11/2015 | Onoda | H01H 85/10<br>337/191 |
| 2017/0213682 | A1* | 7/2017 | Becker | H01H 85/04 |
| 2018/0047539 | A1* | 2/2018 | Kang | H01H 85/048 |

* cited by examiner

FUSES AND METHODS OF FORMING FUSES

FIELD

The present disclosure relates generally to fuses and methods of forming fuses, and, more particularly, to high voltage fuses having improved durability and quality for hybrid electric vehicle applications.

BACKGROUND

High voltage fuses are commonly employed in industrial applications, including but not limited to buildings and facilities, transmission lines, and the like. High voltage fuses may be implemented as cartridge fuses that are configured for connection to other electrical components by additional attachments at the cartridge ends. A shortcoming associated with such fuses is that are susceptible to damage during assembly and can be difficult to inspect for quality control after assembly.

Additionally, high voltage fuses are generally not well-adapted for implementation within vehicles. For example, high voltage fuses that are designed for use in buildings and facilities may not be adapted for exposure to fog, road salt, and/or other weather-related conditions. Furthermore, while high voltage fuses used in buildings and facilities may remain stationary, fuses deployed in vehicles may be subject to varying vibrations and other forces while the vehicle is in motion.

It is with respect to these and other considerations that the present improvements may be useful.

SUMMARY

This Summary is provided to introduce a selection of concepts in a simplified form that are further described below in the Detailed Description. This Summary is not intended to necessarily identify key features or essential features of the claimed subject matter, nor is it intended as an aid in determining the scope of the claimed subject matter.

According to an exemplary embodiment of the present disclosure, a fuse may include a leadframe. The leadframe may include a first terminal having a first end and a second end, and a second terminal having a first end and a second end. The second ends may be connected by a bridge having one or more protrusions disposed between the first and second terminals and extending from the bridge. A base may include a first aperture and a second aperture. The first and second terminals may be at least partially disposed within the first and second apertures, respectively, such that the base is disposed between the respective first ends and respective second ends of the first and second terminals. The base may include one or more indentations such that respective ends of the one or more protrusions are received into each of the one or more indentations. A plurality of wires may be connected to the first end of the first terminal and the first end of the second terminal. The plurality of wires may be further connected to each of the one or more protrusions therebetween.

In various of the foregoing and other embodiments, a cover may be disposed over the base, and the cover may include a cavity such that the first end of the first terminal, the first end of the second terminal, and the plurality of wires, are enclosed by the cover. The cover and base may contain an arc suppressant. The cover may be attached to the base such that the cover extends around and receives the base into the cavity of the cover. At least a portion of each of the first and second terminals may extend into the respective first and second apertures of the base in an interference fit. The first terminal may include a first locking protrusion extending from the first end of the first terminal and into engagement with the base to retain the leadframe. The second terminal may include a second locking protrusion extending from the first end of the second terminal and into engagement with the base to retain the leadframe. The bridge may be removable subsequent to the leadframe being received in the base, such that the first terminal, the second terminal, and each of the one or more protrusions are electrically connected via the plurality of wires. The plurality of wires may be attached to the first and second terminals and the one or more protrusions, such that the protrusions support the plurality of wires extending between the first and second terminals. The base may include a first collar extending around the first aperture such that the first terminal is supported by the first collar. A second collar may extend around the second aperture such that the second terminal is supported by the second collar. The first and second collars may be protrusions extending from a first surface of the base towards the respective first ends of the first and second terminals.

According to an exemplary embodiment of the present disclosure, a method of forming a fuse may include connecting a leadframe to a base. The leadframe may include a first terminal having a first end and a second end and a second terminal having a first end and a second end. The second ends may be connected by a bridge, and the base may include a first aperture and a second aperture to receive the respective first and second terminals. A plurality of wires may be bonded at the first end of the first terminal and the first end of the second terminal. A cover may be attached to the base. The cover may include a cavity such that the first end of the first terminal and the first end of the second terminal are enclosed by the cover.

In various of the foregoing and other embodiments, the first and second terminals may be at least partially received into the respective first and second apertures such that the base is disposed between the respective first ends and respective second ends of the first and second terminals. The base may include one or more indentations to receive respective ends of the one or more protrusions. The bridge may have one or more protrusions disposed between the first and second terminals and extending from the bridge. The plurality of wires may be connected to each of the one or more protrusions therebetween. The bridge may be removed subsequent to the connecting the leadframe and the base, such that the first terminal, the second terminal, and each of the one or more protrusions are electrically connected via the plurality of wires. The plurality of wires may be attached to the first and second terminals and the one or more protrusions, such that the protrusions support the plurality of wires extending between the first and second terminals. The first terminal may include a first locking protrusion extending from the first end of the first terminal and engageable with the base to retain the leadframe. The second terminal may include a second locking protrusion extending from the first end of the second terminal and engageable with the base to retain the leadframe. The cavity of the cover may be filled with an arc suppressant. The base may include a first collar around the first aperture such that the first terminal is supported by the first collar. The base may include a second collar around the second aperture such that the second terminal is supported by the second collar. The first and second collars may be protrusions extending from a first surface of the base towards the respective first ends of the first and second terminals.

BRIEF DESCRIPTION OF THE DRAWINGS

Non-limiting embodiments of the present disclosure are described by way of example with reference to the accompanying figures, which are schematic and not intended to be drawn to scale. In the figures, each identical or nearly identical component illustrated is typically represented by a single numeral. For purposes of clarity, not every component is labeled in every figure, nor is every component of each embodiment shown where illustration is not necessary to allow those of ordinary skill in the art to understand the disclosure. In the figures.

DETAILED DESCRIPTION

The present disclosure is not limited to the particular embodiments described herein. The terminology used herein is provided for the purpose of describing particular embodiments of the present disclosure only and is not intended to be limiting beyond the scope of the appended claims. Unless otherwise defined, all technical terms used herein have the same meaning as commonly understood by those of ordinary skill in the art to which the disclosure belongs.

As used herein, the singular forms "a," "an," and "the" are intended to include the plural forms as well, unless the context clearly indicates otherwise. It will be further understood that the terms "comprises" and/or "comprising," or "includes" and/or "including" when used herein, specify the presence of stated features, regions, steps elements and/or components, but do not preclude the presence or addition of one or more other features, regions, integers, steps, operations, elements, components and/or groups thereof.

According to exemplary embodiments of the present disclosure, high voltage fuses for vehicles, such as hybrid electric vehicles, may be formed to better withstand environmental demands related to vehicles. Additionally, fuse components may be designed to allow for automated assembly, which may minimize damage to the components and improve reliability of the fuses. Automated assembly may allow for reliable and repeatable soldering, bonding, epoxying, staking, and the like, to form and seal the fuse, and may also reduce handling and potential damage of the fuse during assembly, as opposed to manual assembly. Manual assembly may be less repeatable than automation, and handling during assembly may damage components, e.g., a leadframe may become cracked or otherwise damaged such that the fuse may not react properly in an electrical event, possibly damaging other electrical components in a system.

Referring now to the Figures, exemplary embodiments of fuses and methods of forming fuses according to the present disclosure may allow for automated assembly, and may be configured to address unique environmental requirements for electrical components in vehicles, and may improve operational performance of the fuse.

Figure 1:
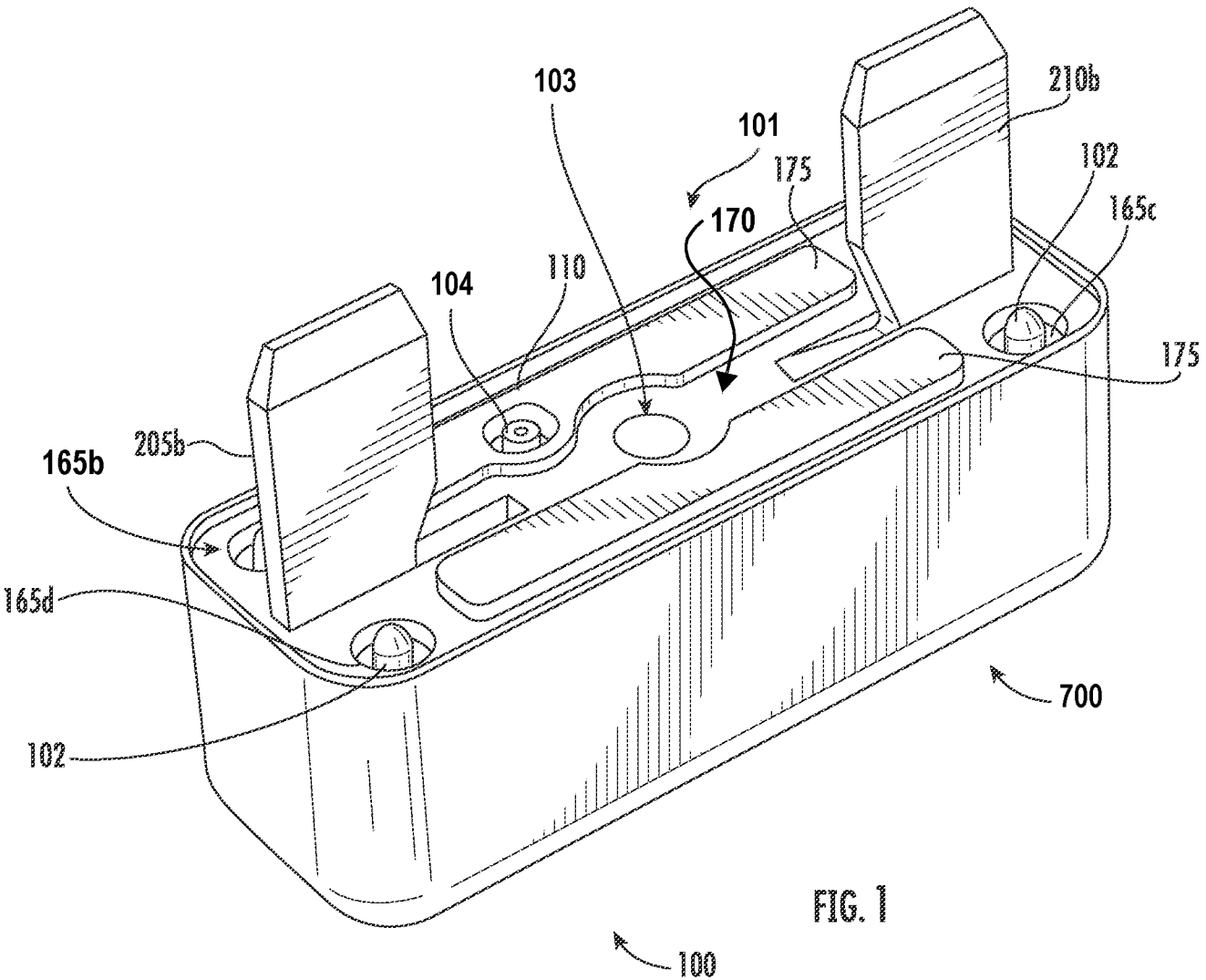
FIG. 1 illustrates an exemplary embodiment of a fuse in accordance with the present disclosure.

An exemplary embodiment of a fuse 100 (see FIG. 1) may include a base 101. The base 101 may be formed as a substantially planar element having a thickness t. The base 101 is illustrated as having a rectangular shape, although it is contemplated that the base 101 may be any shape to accommodate a leadframe described herein, e.g., including but not limited to square, elliptical, round, and the like.

Figure 2:
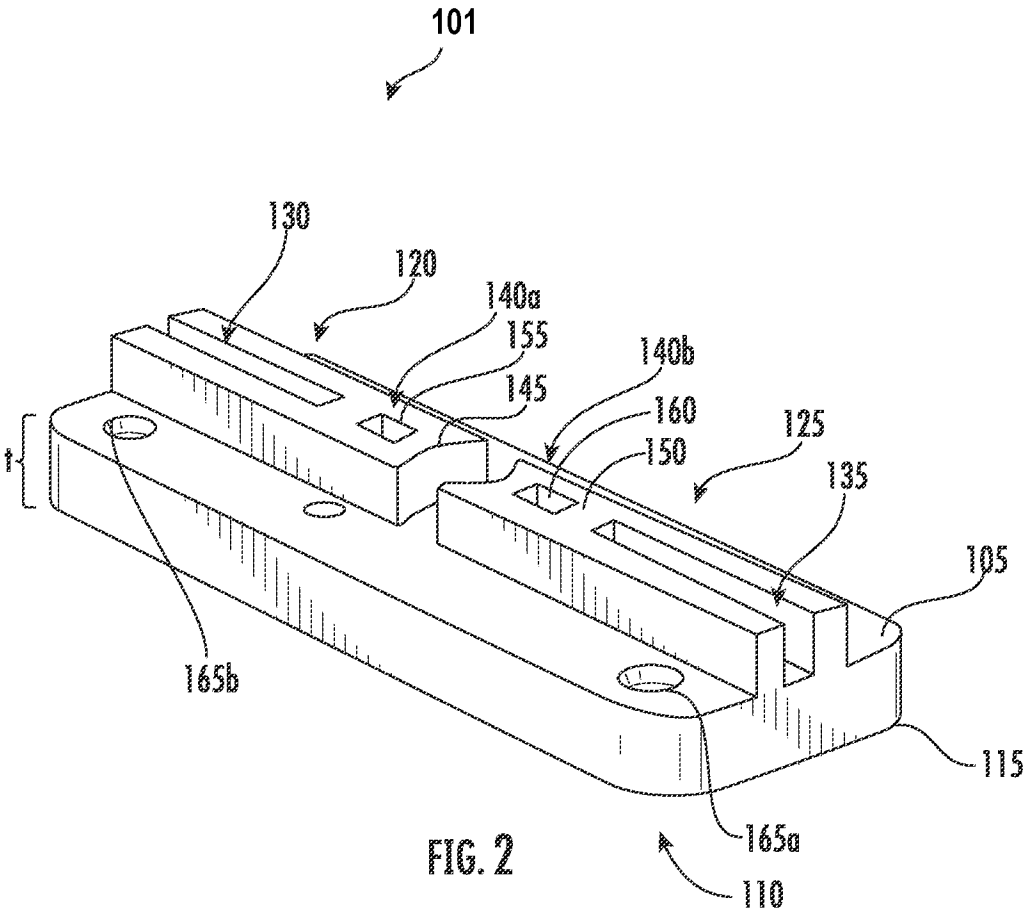
FIG. 2 illustrates an exemplary embodiment of a base of a fuse in accordance with the present disclosure.

Referring to FIG. 2, the base 101 may include a first surface 105, a second surface 110, and a perimeter 115, where the perimeter is the thickness t of the base 101. The base 101 may include a first collar 120 and a second collar 125. The first and second collars 120, 125 may be protrusions extending from the first surface 105. In some embodiments, the first and second collars 120, 125 may be centered on the first surface 105 of the base 101. The first and second collars 120, 125 may be formed around respective first aperture 130 and second aperture 135. In some embodiments, a length of an aperture 130, 135 may be sized smaller than a length of a collar 120, 125, so that a mating surface, e.g., a portion of first surface 105, is defined.

The first and second apertures 130, 135 may be formed as through-slots in the base 101, although it is understood that the first and second apertures 130, 135 may be formed as any shape to receive terminal ends of a leadframe. For example, terminal ends may be a wire, tab, or other configuration. The first and second collars 120, 125 may be formed around the respective perimeters of the apertures, and thus may be any shape conforming to the corresponding aperture.

In some embodiments, the base 101 may further include one or more indentations, or cavities, 140*a*, 140*b*, . . . 140*n*, disposed between the first and second apertures 125, 130. Although first and second indentations 140*a*, 140*b* are illustrated in the Figures, it will be understood that, in various alternative embodiments, the base 101 may include any number "n" of indentations, to at least partially receive protrusions of a leadframe as described herein. In various embodiments, the first and second collars 120, 125 may be formed around the one or more indentations 140*a*, 140*b*, . . . 140*n*, such that protrusions of a leadframe may be receivable into the first and second collars 120, 125, as indicated at reference numerals 145, 150.

In some embodiments of the base 101, the one or more indentations 140*a*, 140*b*, . . . 140*n* may be omitted, although the first and second collars 120, 125 may still include areas 145, 150. For example, the areas 145, 150 of the first and second collars 120, 125 may define a first recess 155 and a second recess 160, for at least partially receiving protrusions of a leadframe. It is understood that while first and second recesses 155, 160 are illustrated, any number "n" of recesses may be formed to receive protrusions of the leadframe. For example, a fuse may be shortened or lengthened and may have any number of protrusion/recess pairs based on the length of the fuse. Increasing a desired voltage of a fuse for safe operation may include adding additional weld areas, which may correspondingly increase the number of fusing sections.

Figure 3:
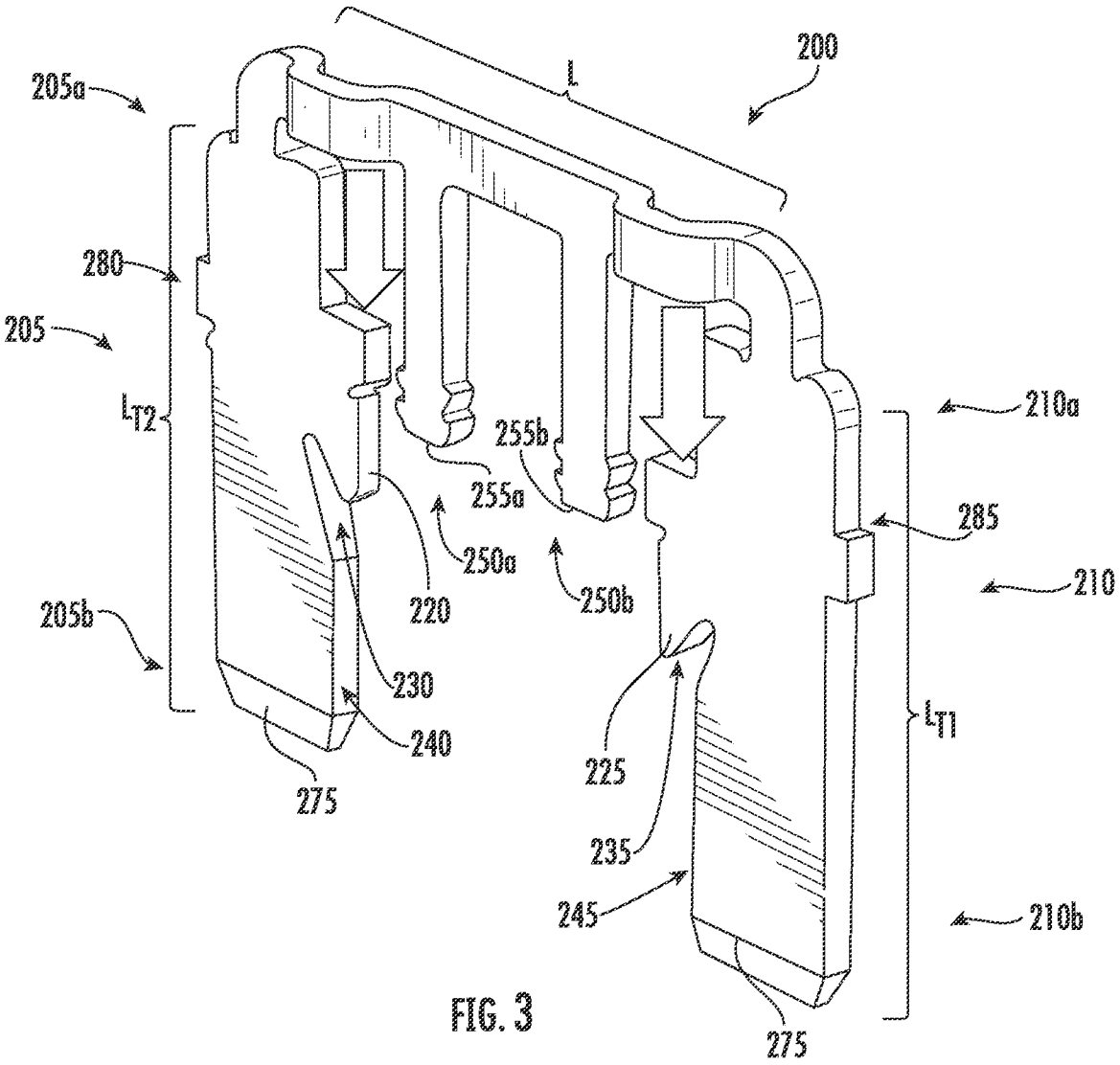
FIG. 3 illustrates an exemplary embodiment of a leadframe in accordance with the present disclosure.

FIG. 3 illustrates an exemplary embodiment of a leadframe 200 adapted for connection with the base 101. The leadframe 200 may be formed as a unitary, stamped element, e.g., stamped from conductive sheet metal such as a copper or copper alloy, stainless steel, and the like. While it is contemplated that the leadframe 200 may alternatively be formed from multiple components that may be soldered or bonded together, a unitary leadframe stamped from sheet metal may better facilitate automation in the forming of a fuse, thereby reducing handling and potential failure points. In some embodiments, a leadframe thickness may be uniform, and may be based on desired electrical requirements (e.g., current-carrying capacity) of the fuse. For example, a leadframe may be sized approximately 0.8 mm thick by 2.8 mm wide for carrying up to 30 A. In some embodiments, a leadframe may be sized approximately that's 0.8 mm thick by 6.3 mm for carrying up to 60 A.

In various embodiments, the leadframe 200 may include a first terminal 205 and a second terminal 210 that may be connected to each other via a bridge 215. The first terminal 205 may have a first end 205*a* and a second end 205*b*, with the first end 205*a* connected to the bridge 215 and the second end 205*b* being free. Similarly, the second terminal 210 may have a first end 210*a* and a second end 210*b*, with the first end 210*a* connected to the bridge 215 and the second end 210*b* being free. The second ends 205*b*, 210*b* may be adapted for connection to other electrical components in a system, e.g., a hybrid electric vehicle. As illustrated, the second ends 205*b*, 210*b* may be formed as blades for connection as a plug-in fuse to the other electrical components.

The first and second terminals 205, 210 may have lengths $L_{T1}$ and $L_{T2}$, respectively, as measured from the bridge 215. $L_{T1}$ may be equal to $L_{T2}$, although in some embodiments, the lengths of the terminals may be different to accommodate connection to other electrical components. The first and second terminals 205, 210 may be connected at opposite ends of the bridge 215, the bridge having a length L.

The first terminal 205 may include a first locking protrusion 220, and the second terminal 210 may include a second locking protrusion 225. The first and second locking protrusions 220, 225 may be formed toward the first ends 205*a*, 210*a* of the respect first and second terminals 205, 210. The first and second locking protrusions 220, 225 may be formed as a prong, or fork, extending out of the respective first and second terminals 205, 210, such that a corresponding first and second recess 230, 235 is defined between the terminals and the locking protrusions. For example, the first recess 230 is defined between the first terminal 205 and the first locking protrusion 220 towards the first end 205*a* of the first terminal 205, and the second recess 235 is defined between the second terminal 210 and the second locking protrusion 225 towards the first end 210*a* of the second terminal 210.

In embodiments, the locking protrusions 220, 225 may be disposed on respective inner portions 240, 245 of the first and second terminals 205, 210, although in some embodiments, the locking protrusion 220, 225 may be disposed anywhere on the first and second terminals such that the base 101 is connectable with the leadframe 200 with the second ends 205*b*, 210*b* of the terminals 205, 210 extending through the respective first and second apertures 130, 135.

The leadframe 200 may include one or more protrusions 250*a*, 250*b*, . . . 250*n*, disposed along the bridge 215 between the first terminal 205 and the second terminal 210. While first and second protrusions 250*a*, 250*b* are illustrated, it is understood that the leadframe 200 may include any number "n" of protrusions extending from the bridge 215. The one or more protrusions 250*a*, 250*b*, . . . 250*n* may be extendable from the bridge 215, e.g., in a similar direction as the first and second terminals 205, 210. The one or more protrusions 250*a*, 250*b*, . . . 250*n* may have a length $L_P$, which may be less than lengths of the first and second terminals $L_{T1}$ and $L_{T2}$. In embodiments, the one or more protrusions 250*a*, 250*b*, . . . 250*n* may extend a length such that respective ends 255*a*, 255*b*, . . . 255*n* may be towards the first ends 205*a*, 210*a* of the first and second terminals 205, 210. The one or more protrusions 250*a*, 250*b*, . . . 250*n* may be disposed equidistantly from each other and the first and second terminals 205, 210 along the bridge 215.

Figure 4A:
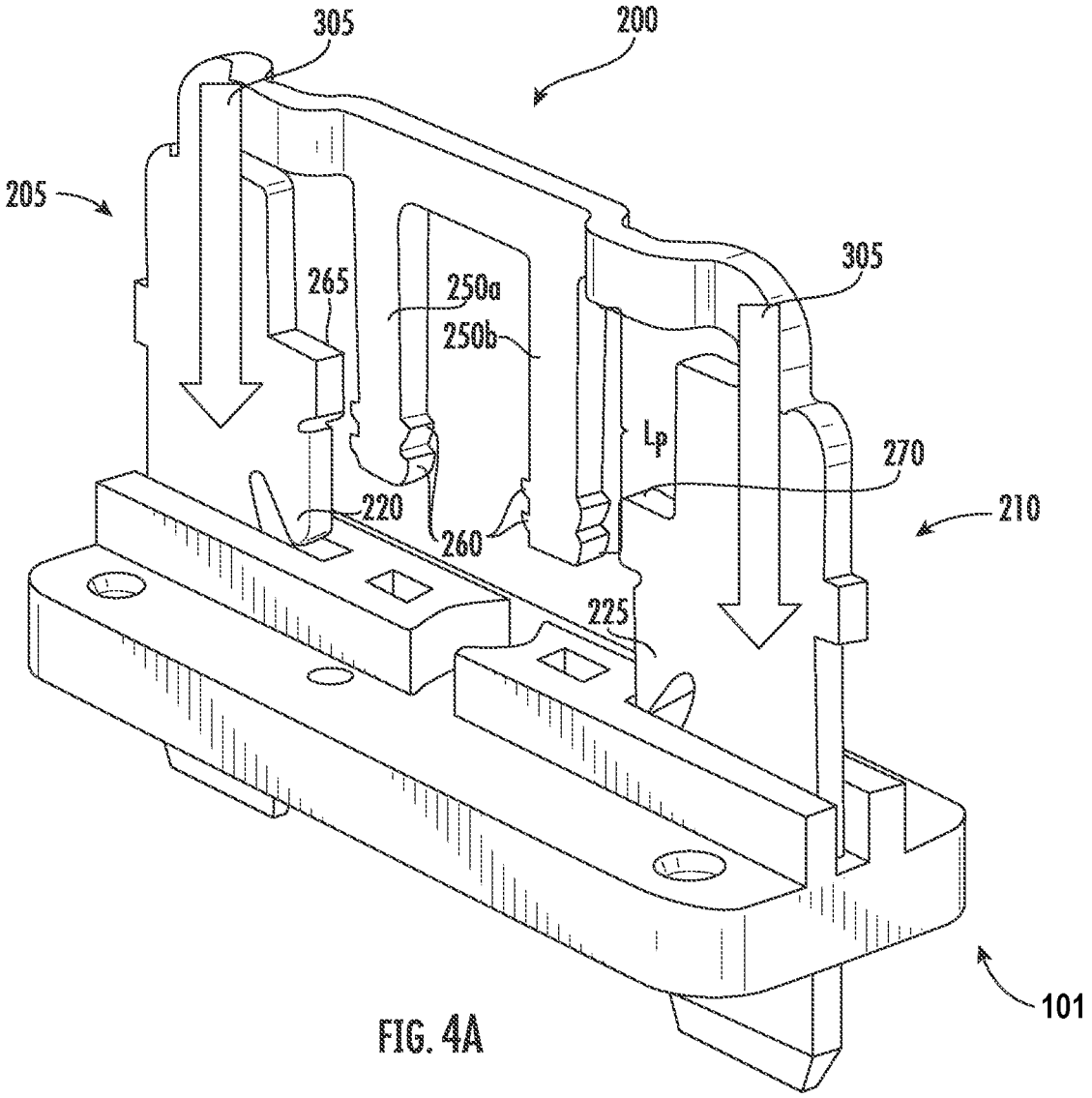
FIGS. 4A-4B are a series of views illustrating an exemplary manner in which the base of FIG. 2 may be connected with the leadframe of FIG. 3 in accordance with the present disclosure.
Figure 4B:
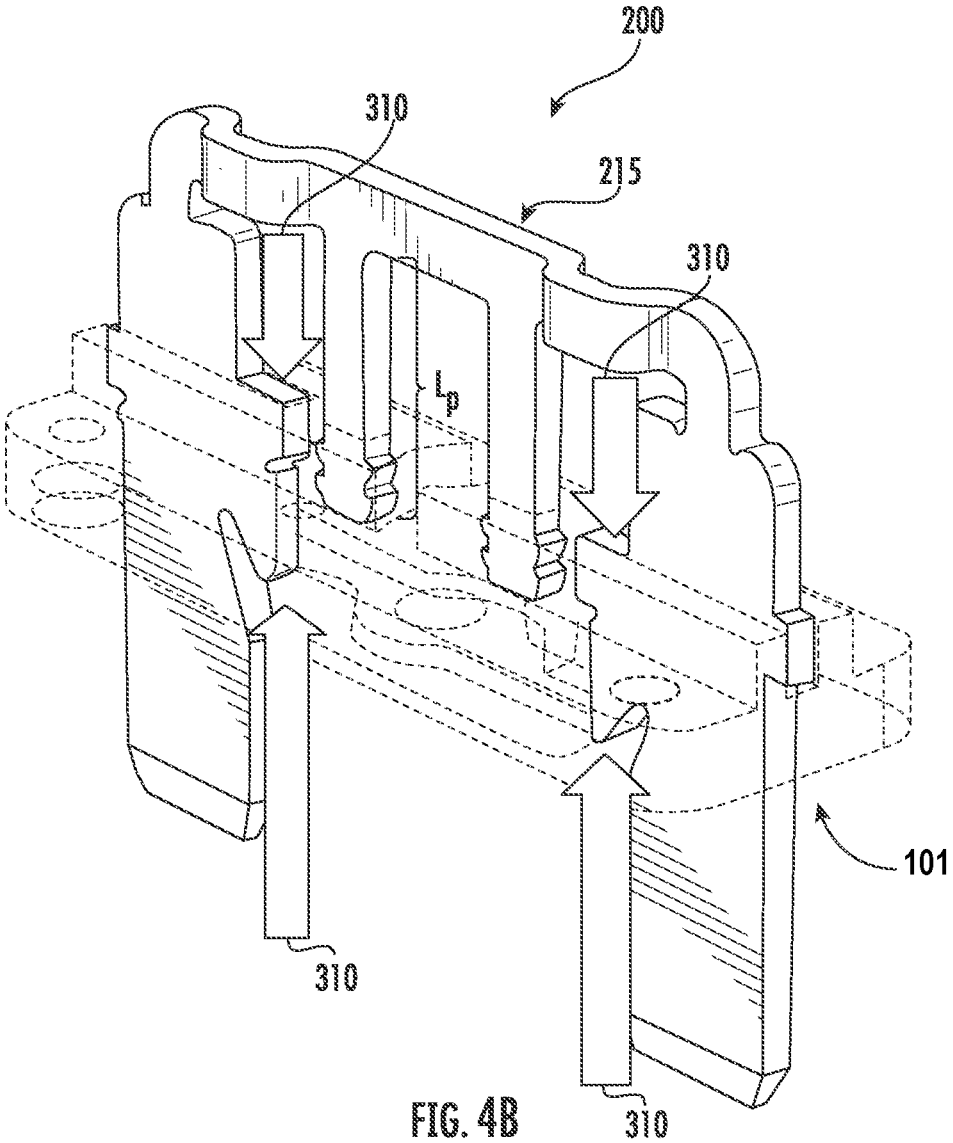

To connect the leadframe 200 with the base 101, the first terminal 205 may be positioned through the first aperture 130, and the second terminal 210 may be positioned through the second aperture 135, from the first surface 105 through the second surface 110, as shown in FIGS. 4A-4B by arrows 305. The base 101 may be formed symmetrically longitudinally, e.g., so that either one of the first terminal 205 or the second terminal 210 may be receivable in the first aperture 130, and the other of the first or second terminals 205, 210 may be receivable in the second aperture 135.

The base 101 may be connected to the leadframe 200 so that the second ends 205*b*, 210*b*, extend out of the second surface 110, and the base 101 is positioned towards the first ends 205*a*, 210*b*. The first and second collars 120, 125 may support the respective first and second terminals 205, 210 extended through the first and second apertures 130, 135, and may allow for the entire leadframe 200 to be connected into the base 101 simultaneously. In some embodiments, the first and second terminals may include corresponding first and second stops 280, 285 disposed towards the respective first ends 205*a*, 210*a* of the first and second terminals 205, 210. As shown in FIGS. 3, 4A-4B, the stops 280, 285 are rectangular shaped, to match with the projection shape of the first and second collars 120, 125 on the base 101. In embodiments, the stops 280, 285 may be any shape to fill the space of the collars 120, 125 of the base 101.

The areas 145, 150 of the respective first and second collars 120, 125 having the recesses 155, 160, or indentations 140*a*, 140*b*, . . . 140*n*, may each receive the ends 255*a*, 255*b*, . . . 255*n* of the one or more protrusions 250*a*, 250*b*, . . . 250*n*. In embodiments with the defined recesses 155, 160, the ends 255*a*, 255*b*, . . . 255*n* may be receivable so that the ends 255*a*, 255*b*, . . . 255*n* contacts the first surface 105. In embodiments with the indentations 140*a*, 140*b*, . . . 140*n*, the ends 255*a*, 255*b*, . . . 255*n* may be receivable into the respective indentation 140*a*, 140*b*, . . . 140*n*, e.g., beyond the first surface 105 of the base 101.

In embodiments, the one or more protrusions 250*a*, 250*b*, . . . 250*n* may include locking elements 260, and may be formed as any projecting feature including but not limited to barbs, arrows, projection, hook, and the like. When the one or more protrusions 250*a*, 250*b*, . . . 250*n* are inserted into the areas 145, 150, in the direction indicated by arrows 305, the locking elements 260 may lock the leadframe 200 with the base 101, thereby preventing a disconnection. Any number of locking elements 260 may be included on each of the one or protrusions 250*a*, 250*b*, . . . 250*n*, and may project from the respective ends 255*a*, 255*b*, . . . 255*n* in any direction to lock into the areas 145, 150.

In some embodiments, the first and second locking protrusions 220, 225 may engage with the base 101. The first and second locking protrusions 220, 225 may engage in the corresponding first and second apertures 130, 135, such that the leadframe is locked in position with the base 101, thereby preventing disconnection. In some embodiments, at least a portion of the first and second apertures 130, 135 may engage in the first and second recesses 230, 235, such that the corresponding locking protrusions 220, 225 are received and held in an interference fit to lock the first and second terminals 205, 210. In some embodiments, the locking protrusions 220, 225 may be deformed to lock into the corresponding apertures 130, 135. In some embodiments, an upward force may be applied by tooling to the locking protrusions 220, 225, as shown by arrows 310, which may rotate the locking protrusions 220, 225 away from the respective terminals 205, 210 (see FIGS. 6B-6C). When the locking protrusions 220, 225 are deformed, and along with the stops 280, 285, the leadframe 200 may be held together and thereby prevented from separating from the base 101.

The leadframe 200 may be locked to the base 101 by cold staking, e.g., an interference fit, with the first and second locking protrusions 220, 225. The leadframe 200 may include a first pad 265 and a second pad 270, for connecting and locking the leadframe 200 and the base 101 together. The first and second pads 265, 270 may be formed as flat surfaces, e.g., in a plane substantially parallel to the first surface 105 of the base 101, and disposed directly above the respective first and second locking protrusions 220, 225.

In embodiments, the leadframe 200 may be formed in a single plane, e.g., flat, so that the first and second terminals 205, 210 may lie in the same plane as the bridge 215. In some embodiments, the bridge 215 may include one or more curvatures which may result in the first and second terminals 205, 210 laying in a plane different from at least a portion of the bridge 215. A curvature in the bridge 215 of the leadframe 200 may allow for clearance for tooling during assembly. For example, automated tooling may press the leadframe 200 into the base 101 (see FIGS. 4A-4B). Additionally or alternatively, the curvature may allow for tooling to hold the leadframe 200 for sealing and/or staking. In embodiments, tooling may extend substantially perpendicular to pads 265, 270 and apply downward forces indicated by arrows 310. It is envisioned that the curvature in the bridge 215 may still allow the terminals 205, 210, and/or the protrusions 250*a*, 250*b* to be in the same plane for easy insertion in the base 101.

To align the leadframe 200 and the base 101 for connection, the first terminal 205 may be aligned with the first aperture 130, and the second terminal 210 may be aligned with the second aperture 135, so that the first and second pads 265, 270 are substantially parallel to the base 101. In some embodiments, the second ends 205*b*, 210*b* may include lead-in features 275, such as chamfers, bevels, fillets, or the like. Including lead-in features 275 on the second ends 205*b*, 210*b* may allow for easier assembly of the components and allow for self-alignment of the leadframe and base during connection. In some embodiments, the second ends 205*b*, 210*b* may include a taper, e.g., to further improve the lead-in of the terminals 205, 210 into the respective first and second apertures 130, 135. A force may be exerted on the first and second pads 265, 270 in a direction of arrow 310 to connect the leadframe 200, and lock the first terminal, the second terminal, and the one or more protrusions.

When the leadframe 200 is connected and locked to the base 101, the first and second terminals 205, 210 extend through the respective first and second apertures 130, 135. The base 101 may be positioned towards the first ends 205, 210*a*, of the first and second terminals 205, 210, e.g., closer to the bridge 215. As described above, the one or more protrusions 250*a*, 250*b*, . . . 250*n* may be configured to mate with the base 101, so that the base 101 is positioned approximately a distance from the bridge 215 equal to the length $L_P$ of the one or more protrusions 250*a*, 250*b*, . . . 250*n*.

Figure 5:
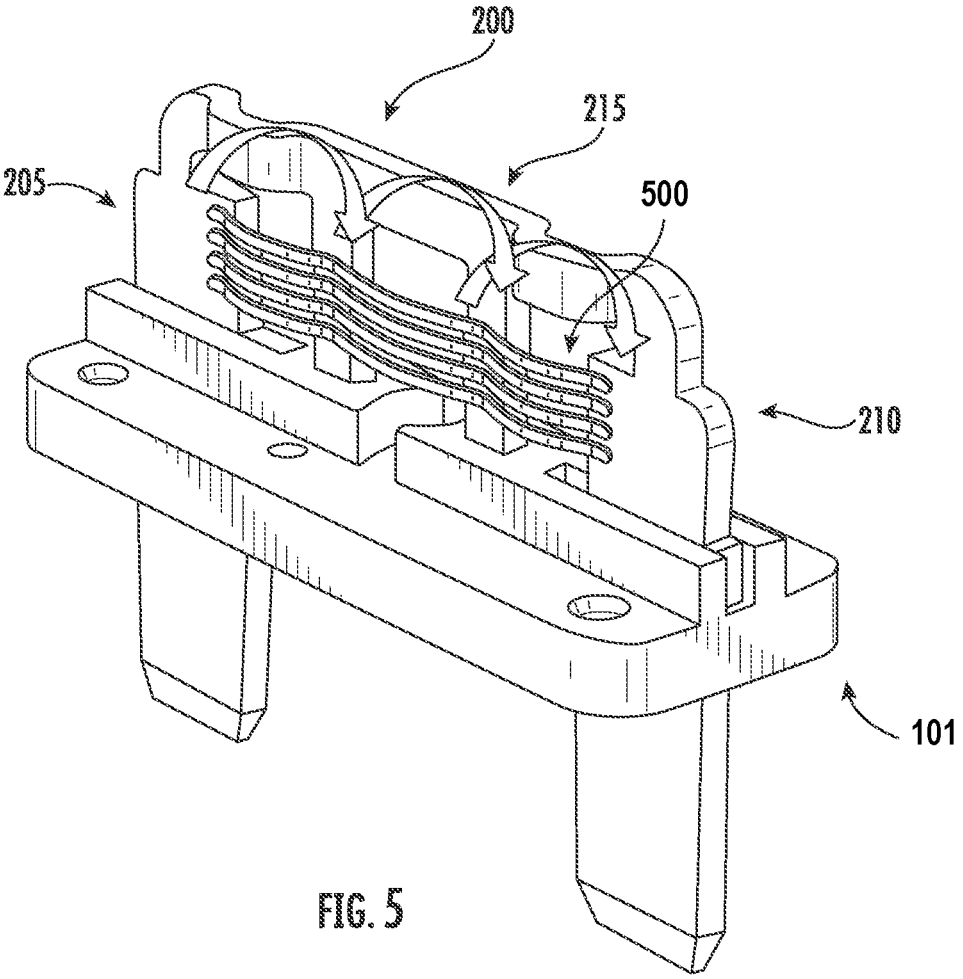
FIG. 5 illustrates an exemplary embodiment of a leadframe including wires in accordance with the present disclosure, with the leadframe connected to the base of FIG. 2.

When the leadframe 200 and the base 101 are connected and locked in position as desired, a plurality of ribbons, or wires, 500 may be attached to the first and second terminals 205, 210, and each of the one or more protrusions 250*a*, 250*b*, . . . 250*n*, as shown in FIG. 5. Although four wires are illustrated, it is understood that any number "n" of conductive wires may be attached to the terminals, and may be determinable by electrical demands of the fuse, e.g., voltage limits of the fuse. The plurality of wires 500 may be soldered, bonded, welded, or otherwise attached to the leadframe 200, and may be formed of a conductive metal such as copper, copper alloys, silver, gold, platinum, zinc, or zinc alloys, or combinations thereof.

The plurality of wires 500 may be attached to the first and second terminals 205, 210 at the respective first ends 205*a*, 210*a*, e.g., just below the bridge 215. It is understood that the plurality of wires 500 may not be attached to the bridge 215. The plurality of wires 500 may further be attached at each of the one or more protrusions 250*a*, 250*b*, . . . 250*n*, which may provide support for the plurality of wires 500 across the length L of the bridge 215 between the first and second terminals 205, 210. In embodiments, the plurality of wires 500 may be wires, although it is understood that any conductive element, such as a single-piece element, may be attached between the first and second terminals 205, 210, and each of the one or more protrusions 250*a*, 250*b*, . . . 250*n*. Additionally, although the plurality of wires 500 are illustrated as substantially straight and parallel, it is understood that any and/or all of the wires 500 may include curvatures, bends, twists, or other configurations, depending on voltage demands of the fuse.

Figure 6A:
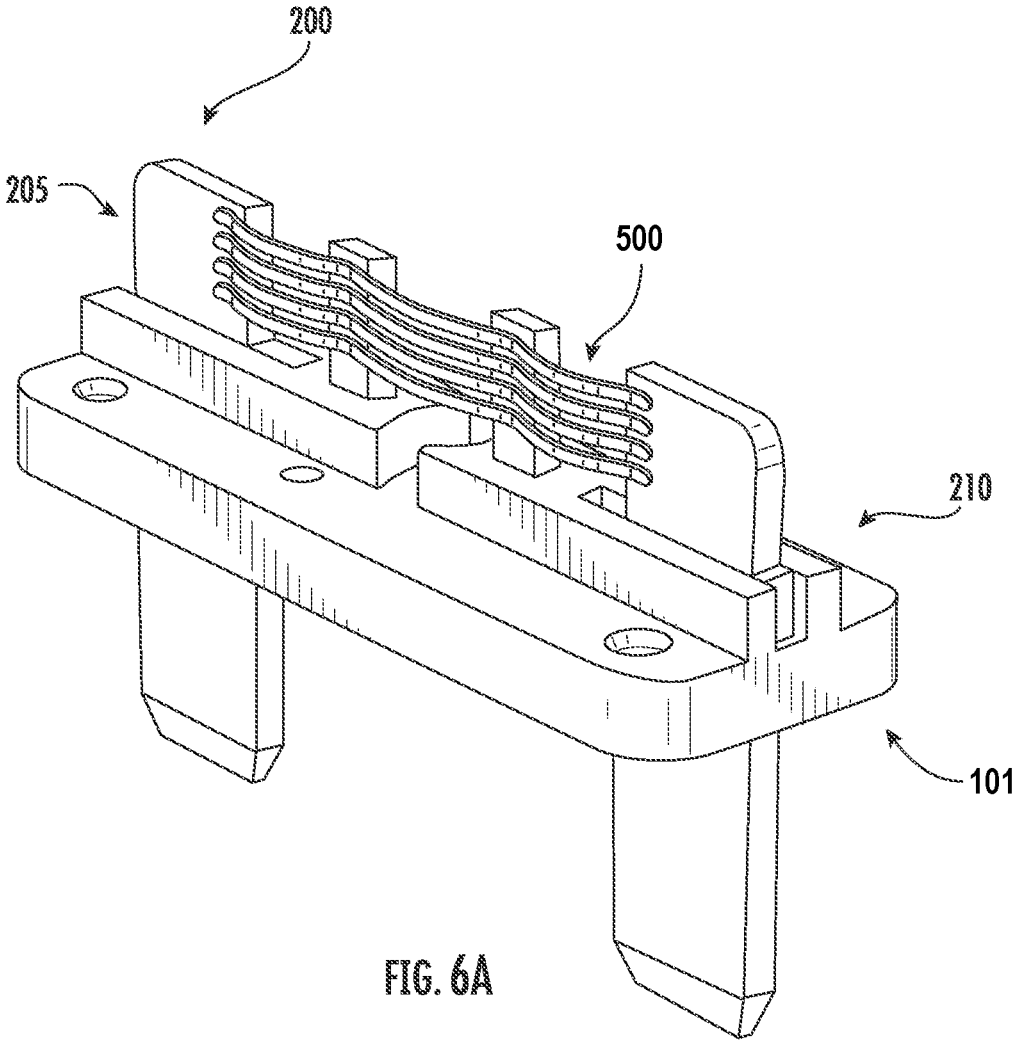
FIG. 6A illustrates a variation of the leadframe of FIG. 4 with a bridge of the leadframe removed, with the leadframe connected to the base of FIG. 2.

Referring now to FIG. 6A, when the plurality of wires 500 have been attached to the first and second terminals 205, 210, and each of the one or more protrusions 250*a*, 250*b*, . . . 250*n*, the bridge 215 may be removed from the leadframe 200. As described above, the plurality of wires 500 may not be connected to the bridge 215 so that the bridge may be easily separated from the remaining leadframe 200. The bridge 215 may be removable subsequent to the leadframe being locked in position in the base 101, and/or subsequent to the attachment of the plurality of wires 500. It is advantageous to remove the bridge 215 only after the leadframe 200 has been locked in position as desired with the base 101, as removal of the bridge 215 separates the first terminal, the second terminal, and each of the one or more protrusions 250*a*, 250*b*, . . . 250*n* from each other. In this manner, the connection of each of the components in the base 101 allows the configuration to be maintained. The bridge 215 may be removable from the leadframe 200 to ensure current may flow only from the first terminal 205, through the plurality of wires 500, to the second terminal 210. In some embodiments, the bridge 215 may be removed by laser cut, or other automated cutting technologies.

Figure 6B:
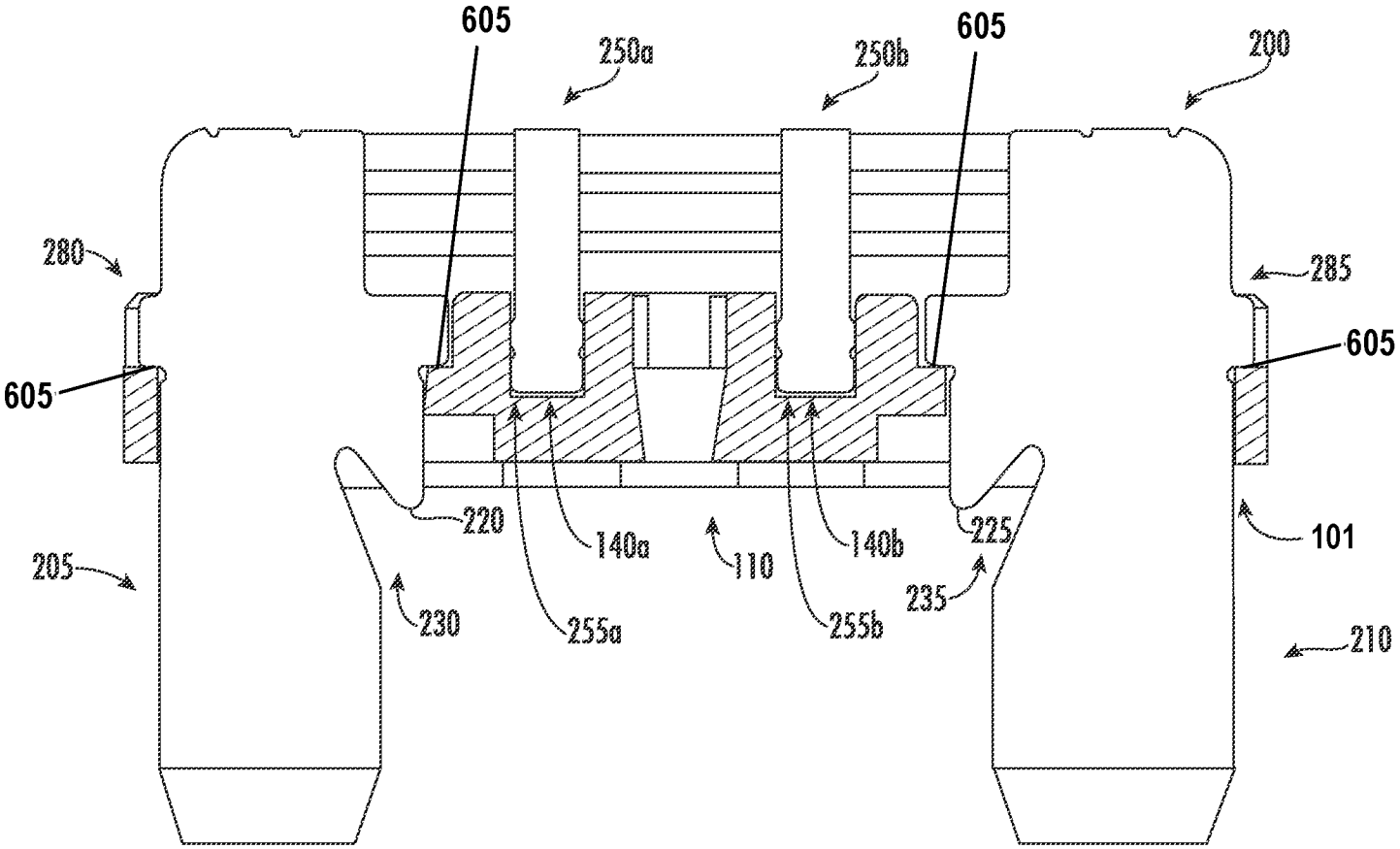
FIG. 6B illustrates a sectional view of the leadframe of FIG. 4 connected to the base of FIG. 2 before the locking protrusions are staked.
Figure 6C:
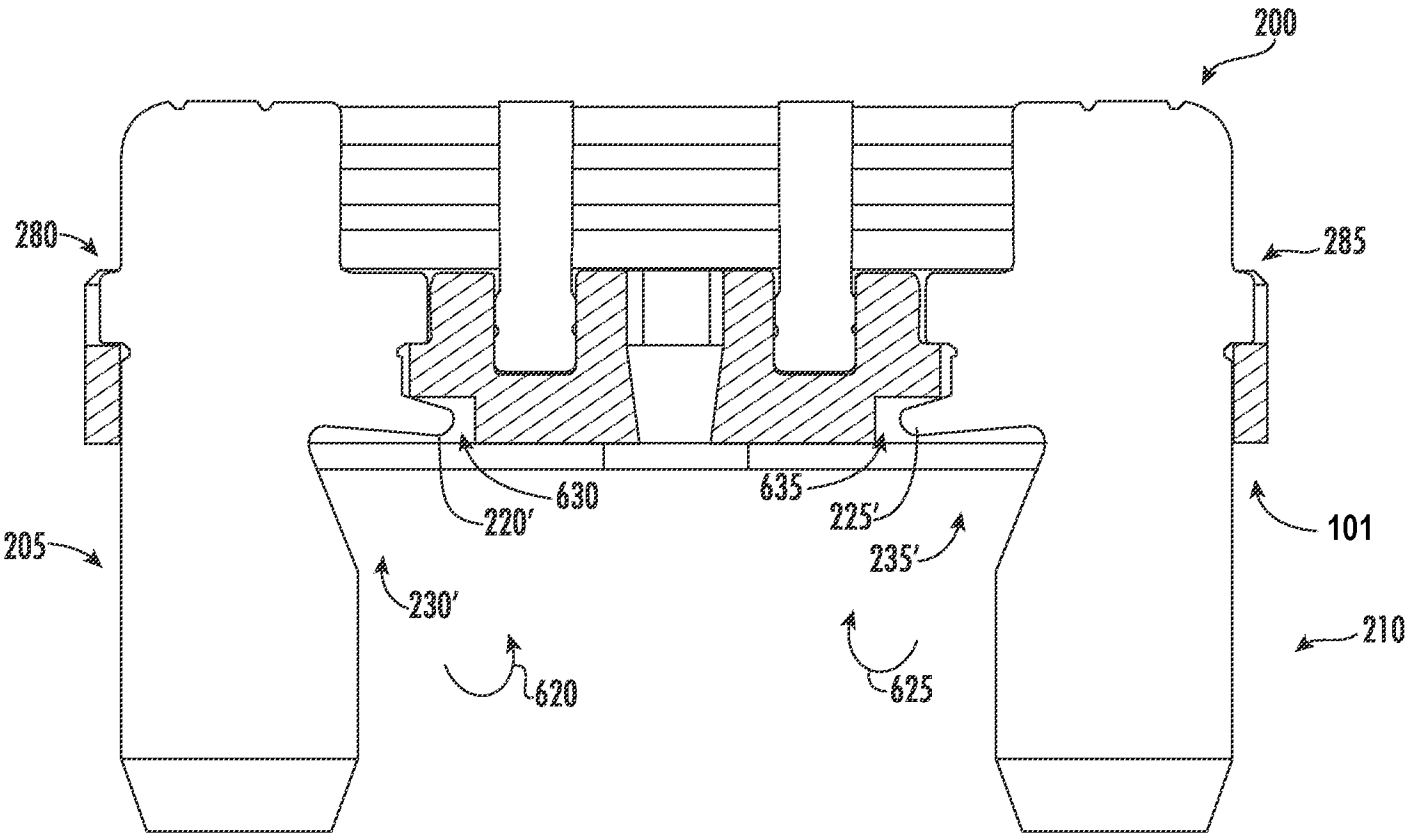
FIG. 6C illustrates a sectional view of the leadframe of FIG. 4 connected to the base of FIG. 2 after the locking protrusions are staked.

Either before or after the bridge 215 has been removed, the leadframe 200 may be locked into the base 101. As shown in FIGS. 6B-6C, the locking protrusions 220, 225 may be heat staked, or deformed, to lock the leadframe 200. The locking protrusions 220, 225 may be rotated away from the respective terminal 205, 210, e.g., in the direction as shown by arrows 620, 625, as shown at reference numerals 220', 225', when a force is applied indicated by arrows 310. The recesses 230, 235 may be increased when the locking protrusions 220', 225' are in the deformed state, as shown in reference numerals 230', 235'. When the locking protrusions 220', 225' have been deformed, they may be disposed in respective recesses 630, 635 of the base 101. The locking protrusions 220', 225' may prevent the leadframe 200 from separating from the base 101 in an upward direction.

Figure 7:
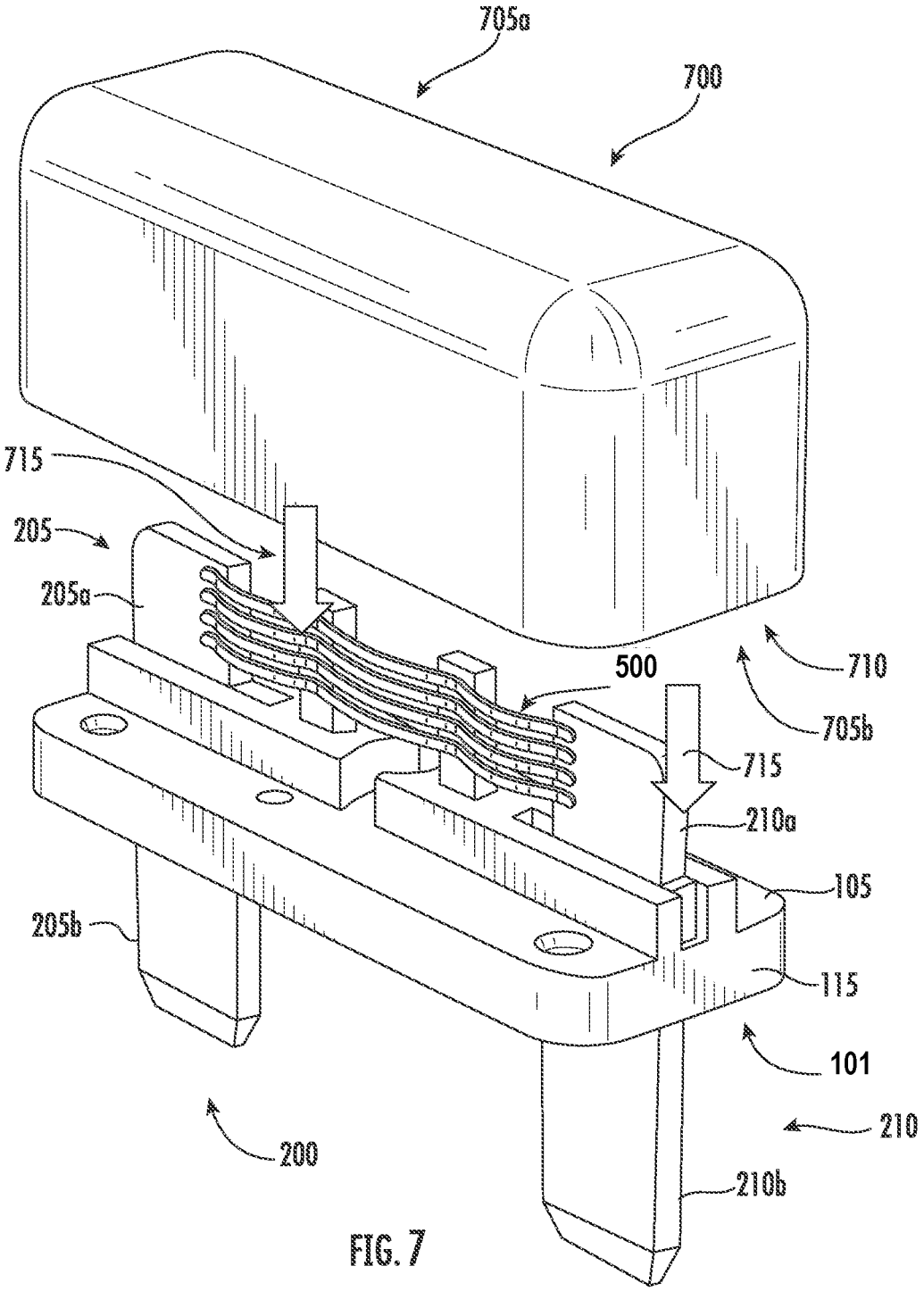
FIG. 7 illustrates an exemplary embodiment of a cover in accordance with the present disclosure for attachment with the leadframe and the base of FIG. 6A.

Additionally, the stops 280, 285 may prevent the leadframe 200 from separating from the base 101 in a downward direction. As described above, mating surfaces 605 may be defined by a collar 120, 125 and corresponding aperture 130, 135 (e.g., a portion of surface 105) to mate with stops 280, 285 of the leadframe 200. The stops 280, 285 may prevent the leadframe 200 from being inserted too far into the base 101, e.g., so that the respective stop 280, 285 may mate against the portion of the surface 105 of the base 101, and may also act at least partially as a locking mechanism to secure the leadframe 200 to the base 101 once the locking protrusions 220, 225 are staked. In some embodiments, the apertures 130, 135 of the base 101 may As shown in FIG. 7, the fuse 100 may further include a cover 700, for enclosing the first ends 205*a*, 210*a* of the first and second terminals, the one or more protrusions 250*a*, 250*b*, . . . 250*n*, the plurality of wires 500, and at least a portion of the base 101. It is understood that prior to enclosing the fuse components, the electrical connections may be inspected to ensure that no connections have been damaged, and/or the fuse may not be at risk of premature failure in an electrical event.

The cover 700 may have a closed end 705*a* and an open end 705*b* to define a cavity 710, such that the fuse components, including but not limited to at least a portion of the leadframe, the plurality of wires 500, and at least a portion of the base 101, are receivable in the cavity 710 of the cover 700. The open end 705*b* of the cover 700 may be attachable to the base 101, e.g., around the perimeter 115, such that the top surface 105 is enclosed in the cavity 710. The entire thickness t of the base 101, e.g., corresponding to the perimeter 115, may be sealed to an inner surface of the cover 700, when the cover 700 is attached to the base 101. In embodiments, the cover 700 may enclose the first ends 205*a*, 210*a* of the first and second terminals 205, 210, the one or more protrusions 250*a*, 250*b*, . . . 250*n*, and the plurality of wires 500, in a direction as shown by arrows 715. When the cover 700 is attached to the base 101, the second ends 205*b*, 210*b* of the first and second terminals 205, 210 are still accessible, through the respective apertures 130, 135 and extending beyond the second surface 110 of the base 101, to form a fuse 100 (see FIG. 1). In some embodiments, the second surface 110 may include a channel 170. The channel 170 may be filled with epoxy or another adhesive to seal the fuse. Some portions of the second surface 110 of the base 101 may not receive adhesive, as indicated at reference numerals 175.

When the cover 700 is positioned as desired relative to the base 101, the cover may be sealed in position. In some embodiments, posts 102 may be disposed in each of through holes 165*a*-165*d*. Referring back to FIG. 2, the through holes 165*a*-165*d* may be positioned on the base 101 in each corner or end, to equally seal the base 101 to the cover 700. Each post 102 may be heat staked in the through hole 165*a*-165*d* to the cover 700, e.g., heat and pressure may be applied to reform each post 102 and the corresponding through holes 165*a*-165*d*, to join each post 102 to the inner surface of the cover 700. Although four posts 102 and corresponding through holes 165*a*-165*d* are illustrated, it is understood that any number "n" of posts may be included to seal the base 101 and the cover 700, and the base 101 may include any number "n" of through holes for receiving the posts. In embodiments, the posts 102 may be disposed equidistantly from each other, so that the cover 700 is evenly sealed to the base 101.

In some embodiments, the base 101 and the cover 700 may be additionally and/or alternatively be sealed by epoxy. For example, epoxy may be disposed around the perimeter 115 of the base 101 to join the base 101 to the inner surface of the cover 700. Epoxy may also be applied to the through holes 165*a*-165*d* and posts 102. In some embodiments, after applying the epoxy, the fuse 100 may be heated, or baked, to cure the epoxy. It is understood that the base 101 may further include a seal vent hole 104. The seal vent hole 104 may be open to allow for fumes to escape without damaging the seal between the base 101 and the cover 700. After the epoxy has been applied around the base 101 and the cover 700, and the posts 102 have been heat staked to the base 101 and the cover 700, the seal vent hole 104 may be closed up, e.g., by heating and reforming the hole, or other sealing means.

In embodiments, the cavity 710 of the cover 700 may be filled with an arc suppressant material, such as silica, or sand. A hole 103 in the base 101 may be disposed in the center of the base 101 for filling the fuse 100 with the arc suppressant material. The hole 103 may be centered in the base 101 so that the arc suppressant material may evenly fill the cavity 710. In embodiments, the arc suppressant material may fill the cavity 710 before the base 101 and the cover 700 are sealed together.

As used herein, references to "an embodiment," "an implementation," "an example," and/or equivalents is not intended to be interpreted as excluding the existence of additional embodiments also incorporating the recited features.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize its usefulness is not limited thereto and the present disclosure can be beneficially implemented in any number of environments for any number of purposes. Thus, the claims set forth below are to be construed in view of the full breadth and spirit of the present disclosure as described herein.

What is claimed is:

1. A fuse, comprising:

a leadframe including a first terminal having a first end and a second end, and a second terminal having a first end and a second end, the second ends of each terminal being connected by a bridge, the bridge having one or more protrusions disposed between the first and second terminals and extending from the bridge;

a base including a first aperture and a second aperture, the first and second terminals being at least partially disposed within the first and second apertures, respectively, such that the base is disposed between the respective first ends and respective second ends of the first and second terminals, and the base further including one or more indentations such that respective ends of the one or more protrusions are received into each of the one or more indentations; and a plurality of wires directly connected to each of the first end of the first terminal and the first end of the second terminal, and further directly connected to each of the one or more protrusions therebetween.

2. The fuse according to claim 1, further comprising a cover disposed over the base, the cover including a cavity such that the first end of the first terminal, the first end of the second terminal, and the plurality of wires are enclosed by the cover.

3. The fuse according to claim 2, wherein the cover and base contain an arc suppressant.

4. The fuse according to claim 2, wherein the cover is attached to the base such that the cover extends around and receives the base into the cavity of the cover.

5. The fuse according to claim 1, wherein at least a portion of each of the first and second terminals extend into the respective first and second apertures of the base in an interference fit.

6. The fuse according to claim 1, wherein the first terminal includes a first locking protrusion extending from the first end of the first terminal and into engagement with the base to retain the leadframe, and the second terminal includes a second locking protrusion extending from the first end of the second terminal and into engagement with the base to retain the leadframe.

7. The fuse according to claim 1, wherein the bridge is removable subsequent to the leadframe being received in the base, such that the first terminal, the second terminal, and each of the one or more protrusions are electrically connected via the plurality of wires.

8. The fuse according to claim 1, wherein the plurality of wires are attached to the first and second terminals and the one or more protrusions, such that the protrusions support the plurality of wires extending between the first and second terminals.

9. The fuse according to claim 1, wherein the base includes a first collar extending around the first aperture such that the first terminal is supported by the first collar, and a second collar extending around the second aperture such that the second terminal is supported by the second collar.

10. The fuse according to claim 9, wherein the first and second collars are protrusions extending from a first surface of the base towards the respective first ends of the first and second terminals.

11. A method of forming a fuse, comprising;

connecting a leadframe to a base, the leadframe including a first terminal having a first end and a second end and a second terminal having a first end and a second end, the second ends connected by a bridge, and the base including a first aperture and a second aperture to receive the respective first and second terminals;

bonding a plurality of wires at each of the first end of the first terminal and the first end of the second terminal;

attaching a cover to the base, the cover including a cavity such that the first end of the first terminal and the first end of the second terminal are enclosed by the cover; and wherein the bridge has one or more protrusions disposed between the first and second terminals and extending from the bridge, the plurality of wires being bonded to each of the one or more protrusions therebetween.

12. The method according to claim 11, wherein the first and second terminals are at least partially received into the respective first and second apertures such that the base is disposed between the respective first ends and respective second ends of the first and second terminals.

13. The method according to claim 11, wherein and the base includes one or more indentations to receive respective ends of the one or more protrusions.

14. The method according to claim 11, further comprising removing the bridge subsequent to the connecting the leadframe and the base, such that the first terminal, the second terminal, and each of the one or more protrusions are electrically connected via the plurality of wires.

15. The method according to claim 11, wherein the plurality of wires are attached to the first and second terminals and the one or more protrusions, such that the protrusions support the plurality of wires extending between the first and second terminals.

16. The method according to claim 11, wherein the first terminal includes a first locking protrusion extending from the first end of the first terminal and engageable with the base to retain the leadframe, and the second terminal includes a second locking protrusion extending from the first end of the second terminal and engageable with the base to retain the leadframe.

17. The method according to claim 11, further comprising filling the cavity of the cover with an arc suppressant.

18. The method according to claim 11, wherein the base includes a first collar around the first aperture such that the first terminal is supported by the first collar, and a second collar around the second aperture such that the second terminal is supported by the second collar.

19. The method according to claim 18, wherein the first and second collars are protrusions extending from a first surface of the base towards the respective first ends of the first and second terminals.

* * * * *